US005375719A

United States Patent [19]

Mittmann et al.

[11] Patent Number: 5,375,719

[45] Date of Patent: Dec. 27, 1994

[54] RECEPTACLE CONFIGURED FOR NESTED STACKING

[75] Inventors: Jeffrey C. Mittmann, West Bend; Alan J. Schommer, Fredonia, both of Wis.

[73] Assignee: The Vollrath Company, Inc., Sheboygan, Wis.

[21] Appl. No.: 195,153

[22] Filed: Feb. 10, 1994

[51] Int. Cl.[5] ..... B65D 21/02

[52] U.S. Cl. ..... 206/518; 206/519; 206/520

[58] Field of Search ..... 206/518, 519, 520

[56] References Cited

U.S. PATENT DOCUMENTS

| | | | |
|---|---|---|---|
| 2,767,755 | 10/1956 | Hill | 206/518 |
| 3,237,780 | 3/1966 | Edwards | 206/520 |
| 4,082,184 | 4/1978 | Hammer | 206/520 |
| 5,261,537 | 11/1993 | Shindo et al. | 206/518 |

FOREIGN PATENT DOCUMENTS

| | | | |
|---|---|---|---|
| 1490636 | 6/1967 | France | 206/519 |

*Primary Examiner*—Joseph Man-Fu Moy

*Attorney, Agent, or Firm*—Foley & Lardner

[57] ABSTRACT

A receptacle configured for nested stacking with a lower receptacle of the same construction includes walls intersecting at corners and with a bottom to form a well having an open top bounded by a rim. The rim lies generally in a first plane and has an inner limit adjacent the well which defines a first area larger than the bottom to facilitate nested stacking. Each wall extends in a first direction generally perpendicular with the first plane toward the bottom to a juncture. The juncture defines a second area slightly larger than the first area so that the juncture extends outward from the well an overlap distance beyond the inner limit of the rim of the lower receptacle to establish a generally line-to-line interference with the rim of the lower receptacle. The receptacle also includes a respective juncture-bump, or deviation, at each corner deviating outward from the well at each corner. The juncture-bump traverses the line-to-line interference established by the juncture with the inner limit of the rim at two loci and extends an enhanced overlap distance beyond the line-to-line interference to establish two enhanced interference sites at each corner.

14 Claims, 3 Drawing Sheets

RECEPTACLE CONFIGURED FOR NESTED STACKING

BACKGROUND OF THE INVENTION

The present invention is directed to a receptacle, such as a pan, which is configured for nested stacking with other receptacles of the same or similar construction.

The advantages of nested stacking of receptacles for storage have long been recognized. Principal among those advantages is the reduced space occupied during storage, and a lesser susceptibility to damage of receptacles stored in a nested orientation. The employment of shoulders, flutes, corrugations, embossings, ridges, and other means of enlarging the perimeter of a receptacle to preclude jamming of adjacent receptacles during nested stacking is known. Several such configurations and structures are discussed in U.S. Pat. No. 5,035,327 to Denzin et al. for "Receptacle Adaptable for Nested Stacking", which is assigned to the assignee of the present application.

The Denzin et al. patent (U.S. Pat. No. 5,035,327) disclosed an improvement over the various structures and configurations discussed therein and provided a receptacle for nested stacking which presents a firm seat for nested stacking which accommodates dimensional differences among receptacles.

The present invention provides another solution to the shortcomings of prior art nested stacking receptacles. In particular, some prior art receptacles provide a circumferential ridge below the upper rim of the receptacle which establishes a slightly larger lateral area than the rim so that in a nested stacked orientation, there is established a line-to-line interference around the circumference of the receptacle between the ridge of an upper receptacle and the rim of a lower receptacle in the stack. The problem with such a line-to-line interference is that it provides opportunities for wobble and tilting because of differences in pan size (even though pans are made within established manufacturing tolerances, they may differ in size), deformation of pans occurring because of normal wear and tear, and other causes of imprecise alignment between adjacent pans. Such a wobble or tilting is not a major problem when only two pans or perhaps three pans are stacked together. However, when stacks of pans are nested several pans high, such wobbling or tilting can be a significant problem contributing to instability of the stacks.

The present invention provides an enhanced interference between adjacent pans in a nested stack which enhances a line-to-line interference provided by an existing stacking structure.

SUMMARY OF THE INVENTION

The invention is a receptacle configured for nested stacking with a lower receptacle of the same construction and includes a plurality of walls intersecting at a plurality of corners and with a bottom to form a well having an open top bounded by a rim. The rim lies generally in a first plane substantially parallel with the bottom; the rim has an inner limit adjacent the well and an outer limit. The inner limit of the rim defines a first area larger than the bottom to facilitate nested stacking. Each wall extends in a first direction from the rim toward the bottom to a juncture, the first direction being generally perpendicular with the first plane. The juncture lies generally in a second plane parallel with the first plane and defines a second area slightly larger than the first area so that the juncture generally extends outward from the well an overlap distance beyond the inner limit of the rim of the lower receptacle. The juncture establishes a generally line-to-line interference with the rim of the lower receptacle to limit depth of insertion of the receptacle within the lower receptacle during nested stacking. The receptacle of the present invention also includes a respective juncture-bump, or deviation, deviating outward from the well across an arcuate range generally centered at the respective corner and generally lying in the second plane. The respective juncture-bump traverses the line-to-line interference established by the juncture with respect to the rim at two loci and extends an enhanced overlap distance beyond the line-to-line interference to establish two enhanced interference sites at each respective corner.

It is therefore an object of the present invention to provide a receptacle configured for nested stacking with a lower receptacle of the same construction which provides reliable stable stacking in a nested orientation.

A further object of the present invention is to provide a receptacle configured for nested stacking with a lower receptacle of the same construction which resists jamming between adjacent receptacles in a nested orientation.

Yet a further object of the present invention is to provide a receptacle configured for nested stacking with a lower receptacle of the same construction which promotes drying of receptacles in a nested orientation.

Further objects and features of the present invention will be apparent from the following specification and claims when considered in connection with the accompanying drawings illustrating the preferred embodiment of the invention.

DETAILED DESCRIPTION OF THE DRAWINGS

DETAILED DESCRIPTION OF THE INVENTION

Figure 1:
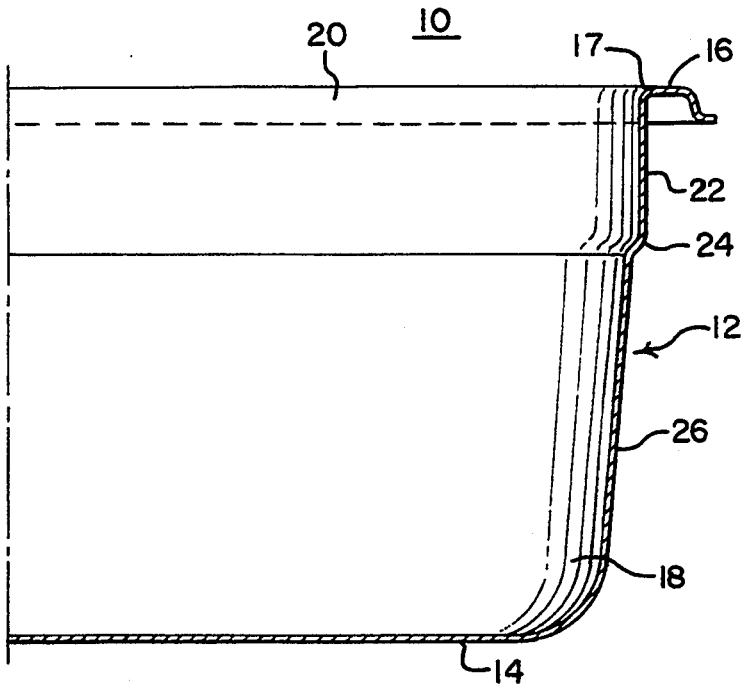
FIG. 1 PRIOR ART
FIG. 1 is a side section view of a portion of a prior art receptacle.

FIG. 1 is a side section view of a portion of a prior art receptacle. In FIG. 1, a receptacle 10 has a wall 12 joining a bottom 14 and a rim 16 to form a well 18 having an open top 20. Rim 16 encloses open top 20 (not shown in its entirety in FIG. 1) and lies generally in a plane. The inner limit 17 of rim 16 bounds well 18. Wall 12 includes a first wall portion 22 which extends from rim 16 toward bottom 14 in a direction generally perpendicular with the plane containing rim 16 to a juncture, or step structure, 24. Wall 12 further includes a second wall portion 26 which extends from juncture 24 to bottom 14. Bottom 14 defines an area smaller than the area defined by inner limit 17 of rim 16 to facilitate nested stacking of receptacles. Juncture 24 lies generally in a plane substantially parallel with the plane containing rim 16. Juncture 24 defines an area slightly larger than the area defined by inner limit 17 of rim 16. Thus, juncture 24 provides a stop which serves to limit insertion depth of receptacle 10 within a lower receptacle of the same construction as receptacle 10 (not shown in FIG. 1). The interference established between juncture 24 and rim 16 of the lower receptacle in a nested stack of receptacles is substantially a line-to-line interference relationship substantially surrounding well 18. The distance between the first plane containing rim 16 and the second plane containing juncture 24 establishes the stack-height of receptacles in a nested stack.

The problem with the prior art receptacles of the configuration illustrated in FIG. 1 is that the line-to-line interference relationship is not a perfectly matched interference because of differences in pans. That is, manufacturing differences, different tolerances, deformation arising from normal wear on pans during operational use, and other factors contribute to less than a perfect match in the line-to-line interference. Such a less than perfect match contributes to wobbling or tilting of one pan with respect to another in a stacked orientation, which wobbling or tilting can be a severe problem, and the problem becomes more severe as the stacks are higher.

Figure 2:
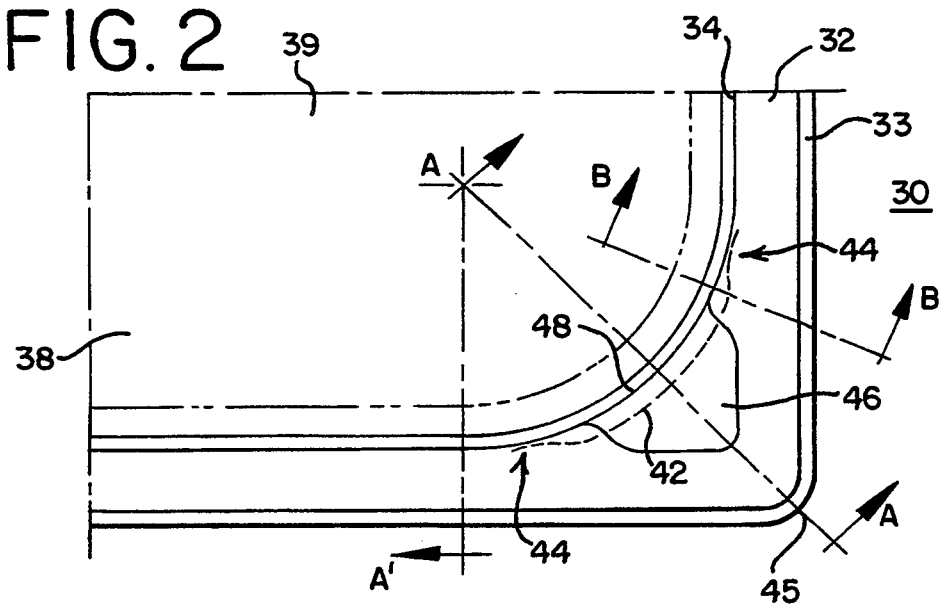
FIG. 2 is a top plan view of a portion of the preferred embodiment of a receptacle according to the present invention.
Figure 3:
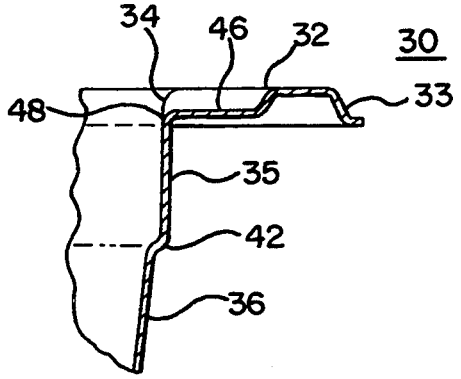
FIG. 3 is a side section view of the preferred embodiment of a receptacle illustrated in FIG. 2, taken along Section A—A of FIG. 2.

FIG. 2 is a top plan view of a portion of the preferred embodiment of a receptacle according to the present invention. FIG. 3 is a side section view of the preferred embodiment of a receptacle illustrated in FIG. 2, taken along Section A—A of FIG. 2. In FIGS. 2 and 3, a receptacle 30 has a rim 32 having a rolled outer edge 33 to provide strength and to resist deformation or bending if the pan should be dropped. Also, rim 32 has an inner limit 34. A top wall portion 35 extends from rim 32 to a juncture-bump 42. A bottom wall portion 36 extends from juncture-bump 42 to bottom 38. As seen in FIG. 2, juncture-bump, or deviation, 42 is a deviation of a juncture such as juncture 24 of FIG. 1 which is present at other circumferential locations about well 39 of pan 30 except at the corners. The juncture analogous to juncture 24 of FIG. 1 which lies below rim 32 elsewhere in pan 30 than at the corners is shown by dotted line 42 to deviate outward from well 39 to form a deviation 42 of the juncture or step structure which may be described as a juncture-bump 42. Juncture-bump 42 intersects the juncture below rim 32 at two loci 44 so that overlap of the juncture lying below rim 32 with respect to rim 32 of a next-lower receptacle of the same construction in a nested stack is enhanced at loci 44. This relationship will be discussed in greater detail in connection with FIGS. 4 and 5. Also illustrated in FIG. 2 is a feature included in the preferred embodiment of the present invention: a planar land 46 which is situated substantially symmetrically about a line 45 bisecting the respective corner of receptacle 30 illustrated in FIG. 2. Planar land 46 lies below the level of rim 32 and intersects well 39 at a boundary 48.

In order to facilitate understanding of the invention, like elements will be referred to using the same reference numerals in the various drawings.

Figure 4:
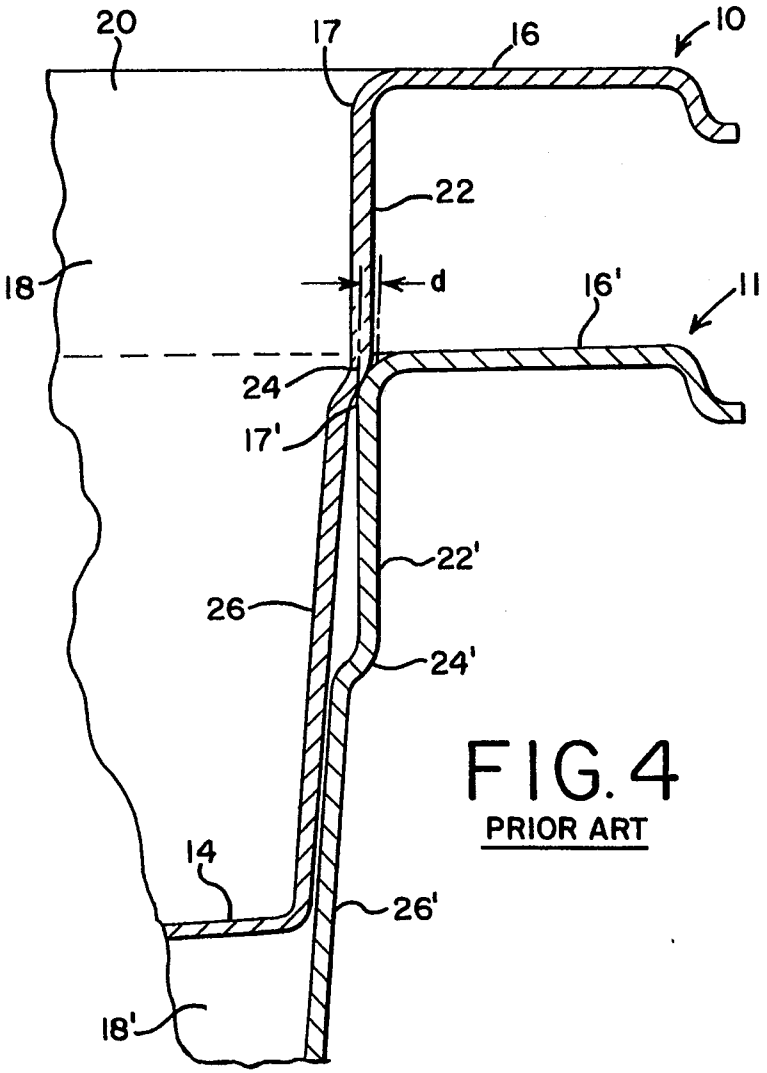
FIG. 4 PRIOR ART
FIG. 4 is a side section view of a portion of two prior art receptacles in a nested orientation.

FIG. 4 is a side section view of a portion of two prior art receptacles in a nested orientation. In FIG. 4, a receptacle 10 is illustrated in a nested orientation with respect to a lower receptacle 11. Receptacle 10 has a rim 16 having an inner limit 17 surrounding an open top 20 to a well 18 defined by a first wall portion 22, a juncture 24, a second wall portion 26, and a bottom 14. Receptacle 11, similarly, has a rim 16′ having an inner limit 17′ surrounding a well 18′ defined by a first wall portion 22′, a juncture 24′, a second wall portion 26′, and a bottom (not shown in FIG. 3).

Continuing to refer to FIG. 4, it may be seen that juncture 24 extends beyond inner limit 17′ of lower receptacle 11 a slight distance "d" (for convenience, referred to as an overlap distance) to establish a line-to-line interference the length of intersection of juncture 24 with inner limit 17′ of lower receptacle 11 around the periphery of wells 18, 18′. The distance between juncture 24 and the plane containing rim 16 of receptacle 10 establishes a stack-height of receptacles when in a nested stacked relationship.

Figure 5:
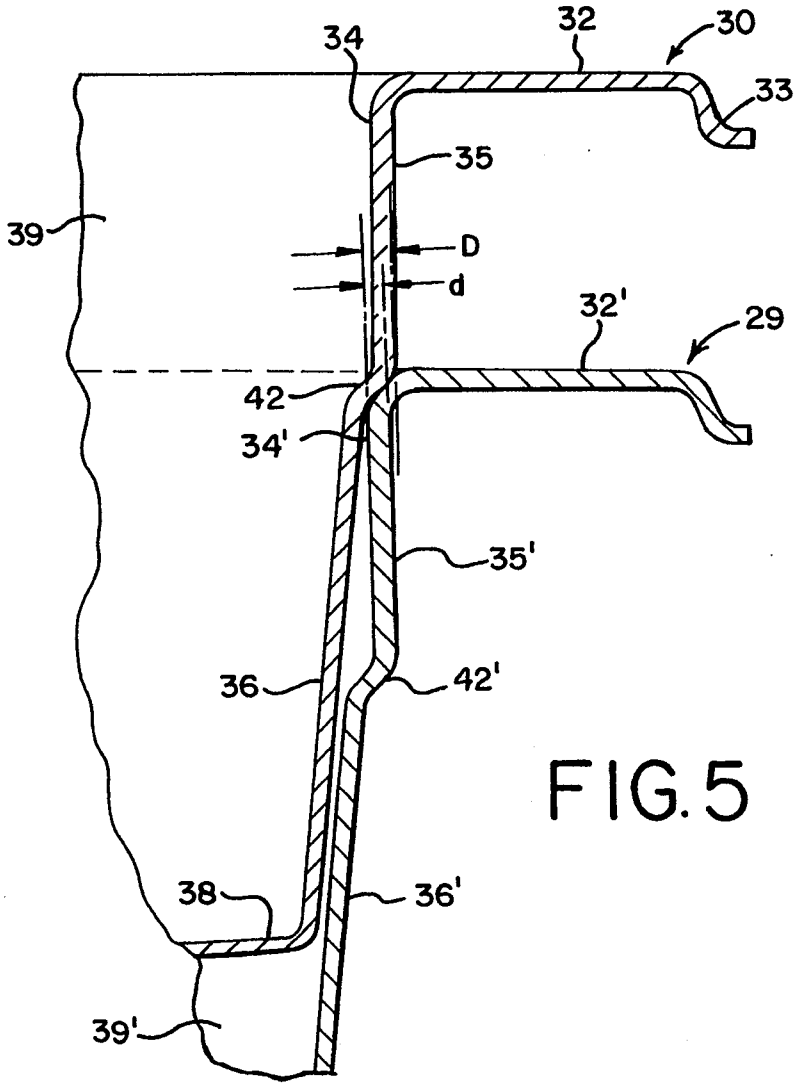
FIG. 5 is a side section view of a portion of one embodiment of two receptacles configured according to the present invention in a nested orientation taken along Section B—B of FIG. 2.

FIG. 5 is a side section view of a portion of one embodiment of two receptacles configured according to the present invention in a nested orientation taken along Section B—B of FIG. 2. In FIG. 5, a receptacle 30 is illustrated having a rim 32 with a rolled outer edge 33 and an inner limit 34 surrounding a well 39. A top wall portion 35 extends from rim 32 toward bottom 38 to a deviation or juncture-bump 42. Juncture-bump 42 interferes with inner limit 34′ of a lower receptacle 29 having a rim 32′, a top wall portion 35′, a juncture-bump 42′, and a well 39′. A bottom wall portion 36 extends from juncture-bump 42 to bottom 38. A bottom wall portion 36′ extends from juncture-bump 42′ to the bottom of receptacle 29 (not shown in FIG. 5). Juncture-bump 42 provides an extended or enhanced overlap distance "D" which is greater than the overlap distance "d" established between pans 29, 30 elsewhere than at loci 44 (FIG. 2) at their corners. It is at loci 44 that deviation or juncture-bump 42 traverses the overlap distance "d". That is, the line-to-line juncture or interference illustrated with respect to the prior art in connection with FIG. 4 between juncture 24 of upper receptacle 10 and inner limit 17′ of lower receptacle 11 is everywhere present in the preferred embodiment of the present invention except between loci 44 in the regions of the respective corners, as illustrated in FIG. 2. It is in those respective corner regions that juncture-bump 42 traverses outward from well 39 beyond the overlap distance "d" to establish enhanced overlap distance "D" providing enhanced interference between juncture-bump 42 of upper receptacle 30 and inner limit 34′ of lower receptacle 29 substantially in the area between loci 44.

Figure 6:
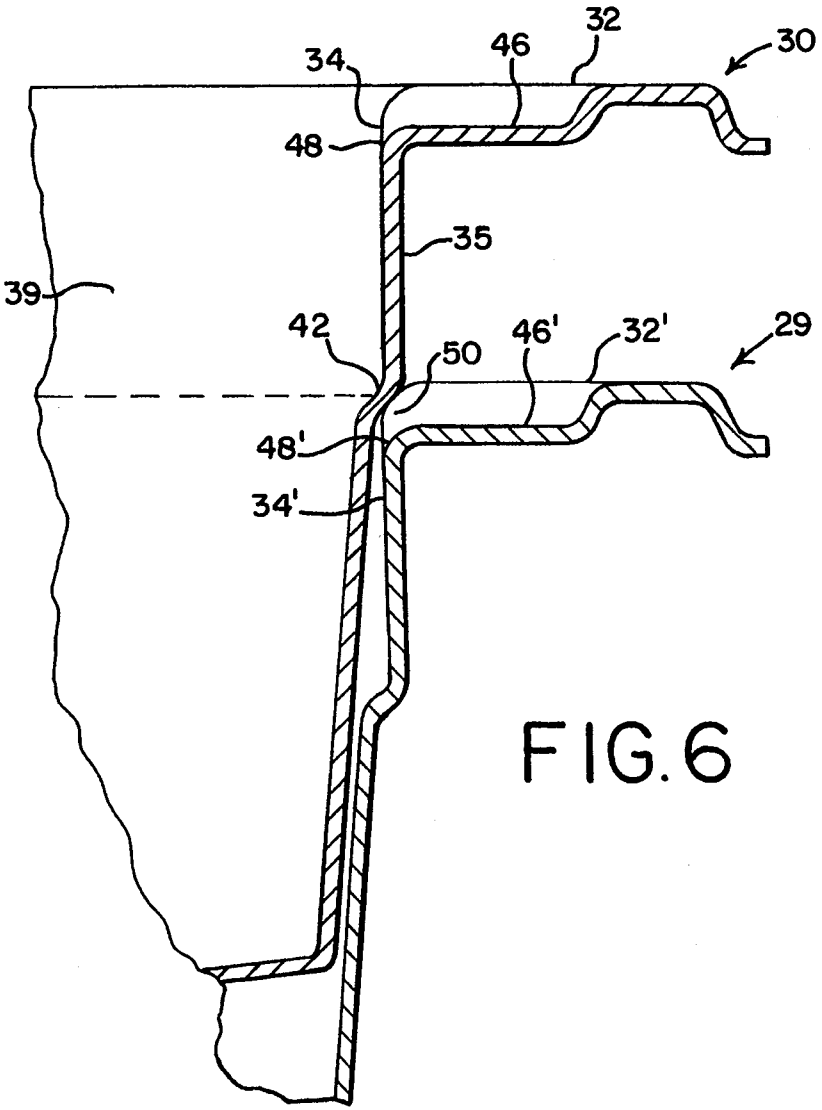
FIG. 6 is a side section view of a portion of two receptacles configured according to the preferred embodiment of the present invention in a nested orientation taken along Section A—A of FIG. 2.

FIG. 6 is a side section view of a portion of two receptacles configured according to the preferred embodiment of the present invention in a nested orientation taken along Section A—A of FIG. 2. In FIG. 6, an upper receptacle 30 is illustrated in nested orientation with respect to a lower receptacle 29. Upper receptacle 30 has a rim 32 with an inner limit 34 and presents a planar land 46 which is situated at a level lower than rim 32 and substantially parallel with the plane containing rim 32. Planar land 46 intersects well 39 at a boundary 48. Upper receptacle 30 includes a top wall portion 35 presenting a juncture-bump 42 overlapping inner limit 34' of lower receptacle 29. Thus, the interference established between upper receptacle 30 and lower receptacle 29 in the preferred embodiment of the present invention illustrated in FIG. 6 in a nested stack orientation is substantially the same interference established with respect to the embodiment of the present invention as illustrated in FIG. 5. That is, an enhanced overlap distance is established between juncture-bump 42 of upper receptacle 30 with respect to inner limit 34' of lower receptacle 29. An important aspect of the preferred embodiment of the present invention illustrated in FIG. 6 is that boundary 48' of planar land 46' of lower receptacle 29 underlies juncture-bump 42 of upper receptacle 30. The gap 50 thus established intermediate boundary 48' of planar land 46' of lower receptacle 29 and juncture-bump 42 of upper receptacle 30 provides a vent to facilitate drying of pans 29, 30 in a nested stack.

Figure 7:
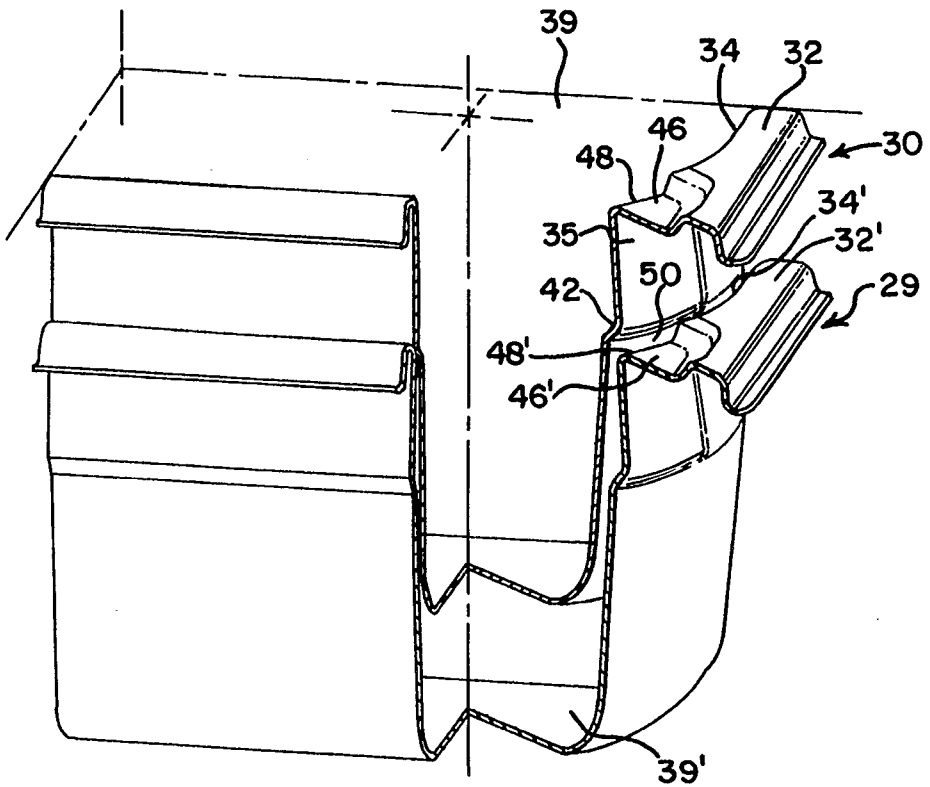
FIG. 7 is a perspective section view of a portion of two receptacles configured according to the preferred embodiment of the present invention in a nested orientation taken along perspective Section A—A—A' of FIG. 2.

FIG. 7 is a perspective section view of a portion of two receptacles configured according to the preferred embodiment of the present invention in a nested orientation taken along perspective Section A—A—A' of FIG. 2. Thus, FIG. 7 is a perspective view of substantially the orientation illustrated in FIG. 6 of a nested stack of receptacles configured according to the preferred embodiment of the present invention. In FIG. 7, an upper receptacle 30 having a rim 32 with an inner limit 34 is nestedly stacked with a lower receptacle 29 having a rim 32' with an inner limit 34'. Upper receptacle 30 has a planar land 46 which intersects well 39 at a boundary 48. Lower receptacle 29 has a planar land 46' having a boundary 48' where it intersects well 39'. A top wall portion 35 of upper receptacle 30 extends from rim 32 to a juncture-bump 42; juncture-bump 42 interferes with inner limit 34' of lower receptacle 29 to establish the enhanced overlap-distance "D" (see FIG. 5) with respect to inner limit 34'. Boundary 48' underlies juncture-bump 42 providing a gap 50 through which air may circulate to facilitate drying of receptacles 29, 30 in a nested stack.

It is to be understood that, while the detailed drawings and specific examples given describe preferred embodiments of the invention, they are for the purpose of illustration only, that the apparatus of the invention is not limited to the precise details and conditions disclosed, and that various changes may be made therein without departing from the spirit of the invention which is defined by the following claims.

We claim:

1. An improved receptacle configured for nested stacking; the receptacle having a plurality of walls intersecting at a plurality of corners and with a substantially planar bottom, said plurality of walls and said bottom defining a well and an open top bounded by a rim, said rim lying generally in a first plane substantially parallel with said bottom; said bottom defining a first area and said rim defining a second area larger than said first area; each respective wall of said plurality of walls departing from said rim toward said bottom in a first direction to a step structure and continuing from said step structure in a second direction to said bottom; said first direction being generally perpendicular with said first plane; said step structure lying generally in a second plane substantially parallel with said first plane and displaced a distance from said first plane; said step structure defining an area slightly larger than said second area to establish an interference between said step structure and the rim of an adjacent lower receptacle of the same construction in a nested orientation to limit depth of insertion of the receptacle within said adjacent lower receptacle, said step structure extending outward from said well an overlap distance beyond an inner limit of said rim of said adjacent lower receptacle, said inner limit being adjacent the well of said adjacent lower receptacle; the improvement comprising:

a respective deviation of said step structure outward from said well at each corner of said plurality of corners, each said respective deviation traversing said overlap distance beyond said rim at two loci and extending an enhanced overlap a distance beyond said loci, each of said loci establishing a locus of enhanced interference.

2. An improved receptacle configured for nested stacking as recited in claim 1 wherein the improvement further comprises a respective substantially planar land at each said respective corner, said planar land being substantially parallel with said first plane; said planar land being situated intermediate said first plane and said second plane, and closer to said first plane than to said second plane; said planar land intersecting said well and underlying said respective deviation of said step structure of a higher receptacle of the same construction in a nested orientation; said two loci being located astride said respective planar land.

3. An improved receptacle configured for nested stacking as recited in claim 2 wherein said respective planar land is substantially symmetrical about a line bisecting said respective corner.

4. An improved receptacle configured for nested stacking as recited in claim 2 wherein said two loci are substantially symmetrically located about a line bisecting said respective corner.

5. An improved receptacle configured for nested stacking as recited in claim 4 wherein said respective corner may be represented in said first plane by an arc having a radius and a center, and wherein said two loci are less than 90° arcuately displaced as measured at said center.

6. An improved receptacle configured for nested stacking as recited in claim 3 wherein said two loci are substantially symmetrically located about said line bisecting said respective corner.

7. An improved receptacle configured for nested stacking as recited in claim 6 wherein said respective corner may be represented in said first plane by an arc having a radius and a center, and wherein said two loci are less than 90° arcuately displaced as measured at said center.

8. A receptacle configured for nested stacking with a lower receptacle of the same construction; the receptacle comprising:

a plurality of walls intersecting at a plurality of corners and with a bottom to form a well having an open top bounded by a rim; said rim lying generally in a first plane substantially parallel with said bottom, said rim having an inner limit adjacent said well and an outer limit, said inner limit defining a first area larger than said bottom to facilitate said nested stacking;

each wall of said plurality of walls extending in a first direction from said rim toward said bottom to a juncture, said first direction being substantially perpendicular with said first plane; said juncture lying generally in a second plane substantially parallel with said first plane; said juncture defining a second area slightly larger than said first area, said first juncture generally extending outward from said well an overlap distance beyond said inner limit of said rim of said lower receptacle, said first juncture establishing a generally line-to-line interference with said rim of said lower receptacle to limit depth of insertion of the receptacle within said lower receptacle during said nested stacking; and a respective juncture-bump at each respective corner of said plurality of corners; each said respective juncture-bump deviating outward from said well across an arcuate range generally centered at said respective corner, said respective juncture-bump traversing said line-to-line interference at two loci and extending an enhanced overlap distance beyond said line-to-line interference to establish two enhanced interference sites.

9. A receptacle configured for nested stacking with a lower receptacle of the same construction as recited in claim 8 wherein the receptacle further comprises a respective substantially planar land at each respective corner of said plurality of corners, said planar land being substantially parallel with said first plane; said planar land being situated intermediate said first plane and said second plane, and closer to said first plane than to said second plane; said planar land intersecting said well and underlying said respective juncture-bump of a higher receptacle of the same construction in a nested orientation; said two loci being located astride said respective planar land.

10. A receptacle configured for nested stacking with a lower receptacle of the same construction as recited in claim 9 wherein said respective planar land is substantially symmetrical about a line bisecting said respective corner.

11. A receptacle configured for nested stacking with a lower receptacle of the same construction as recited in claim 9 wherein said two loci are substantially symmetrically located about a line bisecting said respective corner.

12. A receptacle configured for nested stacking with a lower receptacle of the same construction as recited in claim 11 wherein said respective corner may be represented in said first plane by an arc having a radius and a center, and wherein said two loci are less than 90° arcuately displaced as measured at said center.

13. A receptacle configured for nested stacking with a lower receptacle of the same construction as recited in claim 10 wherein said two loci are substantially symmetrically located about said line bisecting said respective corner.

14. A receptacle configured for nested stacking with a lower receptacle of the same construction as recited in claim 13 wherein said respective corner may be represented in said first plane by an arc having a radius and a center, and wherein said two loci are less than 90° arcuately displaced as measured at said center.

* * * * *